US006275221B1

(12) United States Patent
Song

(10) Patent No.: US 6,275,221 B1
(45) Date of Patent: Aug. 14, 2001

(54) LOW CONSUMPTION POWER CIRCUIT USING AN ELECTRONIC SWITCH IN A DISPLAY MONITOR

(75) Inventor: Moon-Jong Song, Kyungki-do (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/080,368

(22) Filed: May 18, 1998

(30) Foreign Application Priority Data

May 16, 1997 (KR) ..... 1997-10792

(51) Int. Cl.[7] ..... G09G 5/00

(52) U.S. Cl. ..... 345/211; 345/210; 345/212; 348/123; 364/207

(58) Field of Search ..... 345/210, 211, 345/212, 123; 364/207

(56) References Cited

U.S. PATENT DOCUMENTS 5,481,299 * 1/1996 Coffey et al. ..... 345/212
5,675,364 * 10/1997 Stedman et al. ..... 345/212
5,764,547 * 6/1998 Bilich et al. ..... 345/212
5,808,693 * 9/1998 Yamashita et al. ..... 345/211
5,880,719 * 3/1999 Kikinis ..... 345/212
5,917,479 * 6/1999 Haapakoski ..... 345/211
5,926,173 * 7/1999 Moon ..... 345/211
6,005,559 * 12/1999 Miyamoto ..... 345/211

* cited by examiner

*Primary Examiner*—Bipin Shalwala
*Assistant Examiner*—Vincent E. Kovalick
(74) *Attorney, Agent, or Firm*—Robert E. Bushnell, Esq.

(57) ABSTRACT

A low consumption power circuit using an electronic switch in a display monitor is provided, which includes an electronic switch circuit for selecting a power saving mode as the power mode of the display monitor, a microcomputer for generating power off signal according to a switch signal output from the electronic switch circuit, and a main power controller for cutting off DC voltage output from a main power stage when it receives the power off signal from the microcomputer. The microcomputer is turned off using the electronic switch circuit when the display monitor is turned off, so as to minimize the consumption power in the display monitor, resulting in power saving.

8 Claims, 3 Drawing Sheets

LOW CONSUMPTION POWER CIRCUIT USING AN ELECTRONIC SWITCH IN A DISPLAY MONITOR

CLAIM OF PRIORITY

This application makes reference to, incorporates the same herein, and claims all benefits accruing under 35 U.S.C. §119 from an application entitled Low Consumption Power Circuit Using Electronic Switch In Display Monitor earlier filed in the Korean Industrial Property Office on May 16, 1997, and there duly assigned Serial No. 97-10792 by that Office.

BACKGROUND OF THE INVENTION

1. Field of the Invention

The present invention relates to a low consumption power circuit using an electronic switch in a display monitor and, more particularly, to a low consumption power circuit using an electronic switch, which remarkably saves power consumed by a display monitor.

2. Discussion of Related Art

There have been efforts for reducing power consumed by electric and electronic products, to decrease the consumption of electric energy generated using the oil and atomic power and for reducing environmental pollution. Among these electric and electronic products, a display device, a peripherical device of a computer system, uses high voltage so that lots of efforts have been made to reduce its power consumption.

Generally, a display device comprises control means for saving consumption power. In one approach, the control means maybe implemented by a Display Power Management System (DPMS) mode, proposed by Video Electronics Standard Association (VESA) in U.S.A.

The DPMS mode functions to manage power of a display device, which is one of the peripheral devices of a computer, according to a used state of the computer to save the power.

In conformity with the VESA, the computer selectively supplies or blocks horizontal and vertical synchronous signals to the display device according to its used state, and the display device manages power according to the presence of the horizontal and vertical synchronous signals from the computer.

The power management states are classified into an on state, a stand-by state, a suspend state and a power off state. Both the horizontal and vertical synchronous signals are applied at the on state, and only the vertical synchronous signal is applied at the stand-by state. Only the horizontal synchronous signal is applied at the suspend state, and either the horizontal or vertical synchronous signal is not applied at the power off state.

The power management state is sequentially changed to the on state stand-by state suspend state power off state with the continuous lapse of unused time of the computer. It is commonly prescribed that consumption power of the display device be about 80 W at the on state, 65 W or less at the stand-by state, 25 W or less at the suspend state and 5 W or less at the power off state.

SUMMARY OF THE INVENTION

Accordingly, the present invention is directed to a low consumption power circuit using an electronic switch in a display monitor that substantially obviates one or more of the problems due to limitations and disadvantages of the related art.

An object of the present invention is to provide a low consumption power circuit using an electronic switch in a display monitor, which reduces power consumed by the display monitor using an electronic switch when the display monitor is not used for a specific period of time.

To accomplish the object of the present invention, there is provided a low consumption power circuit using an electronic switch in a display monitor, including an electronic switch circuit for selecting power saving mode as a power mode of the display monitor, a microcomputer for generating power off signal according to a switch signal output from the electronic switch circuit, and a main power controller for cutting off DC voltage output from a main power stage when the power off signal is applied from the microcomputer.

It is to be understood that both the foregoing general description and the following detailed description are exemplary and explanatory and are intended to provide further explanation of the invention as claimed.

BRIEF DESCRIPTION OF THE ATTACHED DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Figure 1:
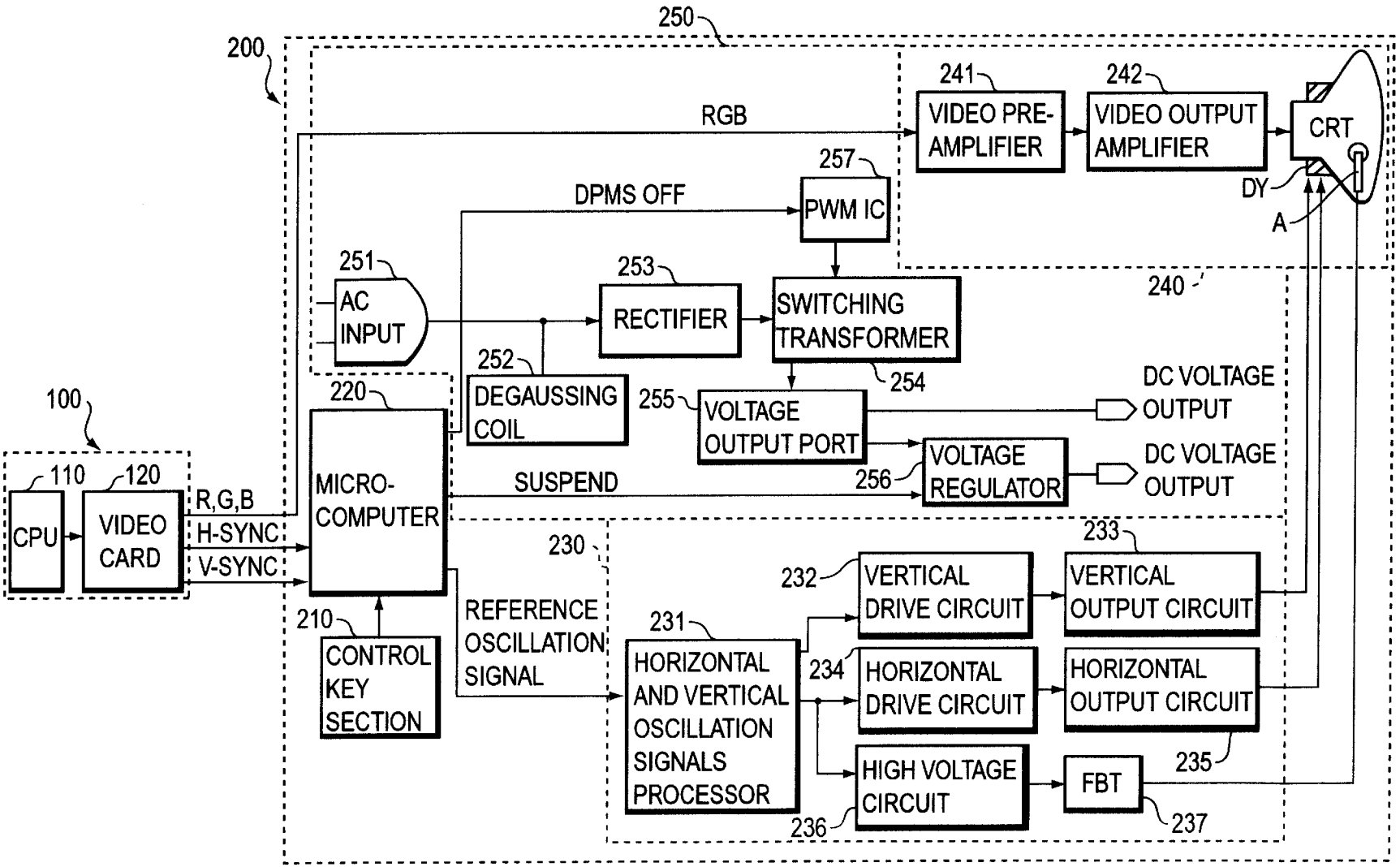
FIG. 1 is a block diagram showing the applicant's representation of an exemplary inner circuit of a display monitor.

A function and operation of reducing the consumption power of the display monitor is explained below with reference to the attached drawings. FIG. 1 is a block diagram showing the inner circuit of an exemplary display monitor. Referring to FIG. 1, a computer 100 includes a central processing unit (CPU) 110 for receiving and processing a keyboard signal to generate data, and a video card 120 for receiving the data from CPU 110, processing it into a RGB video signal, and outputting a horizontal synchronous signal H-SYNC and vertical synchronous signal V-SYNC for synchronizing the RGB video signal.

A display monitor 200, which receives the RGB video signal from video card 120 included in computer 100 and displays it, includes a control key section 210 for generating a key signal for controlling a display monitor picture, a microcomputer 220 for receiving horizontal and vertical synchronous signals H-SYNC and V-SYNC from video card 120, and outputting an image control signal and reference oscillation signal according to the key signal output from control key section 210, a horizontal and vertical output circuit 230 for receiving the image control signal and reference oscillation signal from microcomputer 220, synchronizing the RGB video signal, a video signal processor 240 for receiving the RGB video signal from video card 120, and amplifying and displaying it, and a power circuit 250 for providing drive voltages to microcomputer 220, horizontal and vertical output circuit 230 and video signal processor 240.

Each block of display monitor 200 having the above configuration is described below in detail. Microcomputer 220 receives horizontal and vertical synchronous signals H-SYNC and V-SYNC from video card 120 of computer 100, and outputs the image control signal for controlling images displayed on the picture and reference oscillation signal according to the key signal applied from control key section 210. A horizontal and vertical oscillation signal processor 231 receives the image control signal and reference oscillation signal from microcomputer 220, and generates horizontal and vertical oscillation pulses for controlling the switching speed of turning on/off operation of a sawtooth wave generation circuit according to the horizontal and vertical synchronous signals H-SYNC and V-SYNC applied from video card 120.

The vertical oscillation pulse generated by horizontal and vertical oscillation signal processor 231 is applied to a vertical drive circuit 232 which amplifies it, to output drive current. For vertical drive circuit 232 amplifying the vertical oscillation pulse, a one-stage vertical amplification type is frequently used, and emitter follower type, in which voltage is input to the base of a transistor and output from its emitter, is also used. Accordingly, vertical drive circuit 232 improves linearity rather than gain. A vertical output circuit 233 receives the drive current from vertical drive circuit 232, and generates a sawtooth wave current, corresponding to the vertical synchronous pulse, which is provided to a deflection yoke DY, to determine a vertical scanning cycle.

A horizontal drive circuit 234 receives the horizontal oscillation signal from horizontal and vertical oscillation signal processor 231, and generates drive current for providing sufficient current for turning on/off a horizontal output circuit 235. Horizontal output circuit 235 receives the drive current from horizontal drive circuit 234, and generates a sawtooth wave current which is provided to the deflection yoke DY, to determine a horizontal scanning cycle. The drive mode of horizontal drive circuit 234 is divided into an in-phase (the same polarity) mode in which the output terminal is turned on when the drive terminal is turned on, and reverse phase (reverse polarity) mode, currently widely used, in which the output terminal is turned off when the drive terminal is turned on. To supply a high voltage to the anode A of a cathode ray tube (CRT), a high voltage circuit 236 and flyback transformer 237 (referred to as FBT hereinafter) are driven according to the cycle of the horizontal oscillation pulses output from horizontal and vertical oscillation signal processor 231, to generate the high voltage. This high voltage is applied to the anode A of the CRT, forming the anode face of the CRT.

A video pre-amplifier 241 of video signal processor 240 amplifies the RGB video signal output from video card 120 to a predetermined voltage level. For example, it amplifies a signal of below 1 peak to peak voltage (referred to as Vpp hereinafter) to a signal of 4 to 6 Vpp. The RGB video signal, amplified to 4 to 6 Vpp by video pre-amplifier 241, is applied to a video output amplifier 242 which amplifies the video signal to a signal of 40 to 60 Vpp to provide energy to each pixel of the picture of the CRT, displaying an image. The scanning cycle of the image according to the RGB video signal displayed through the CRT is determined by the deflection yoke DY. The image is displayed on the anode face of the CRT, its luminance being controlled.

Power circuit 250, which supplies a drive voltage for displaying the video signal through the display monitor picture, receives alternating current (AC) through an AC input port 251. The AC, received through AC input port 251, is applied to a degaussing coil 252 which recovers color spread in the CRT picture, generated by terrestrial magnetism or external conditions, to the original color. The AC is rectified by a rectifier 253, to be applied as direct current (DC) to a switching transformer 254. Switching transformer 254 receives the DC, and outputs various drive voltages required for blocks inside monitor 200 through a voltage output port 255. Here, when error in the drive voltages output through voltage output port 255 is generated, it is detected by a pulse width modulation (PWM) IC 256. PWM IC 256 controls ON/OFF time according to the detected error, stabilizing the voltages output through voltage output port 255.

To save the power consumed by display monitor 200, microcomputer 220 executes the DPMS mode depending on whether or not the horizontal and vertical synchronous signals are received from video card 120. That is, microcomputer 220 applies a suspend mode to a voltage regulator 256 to cut off deflection voltage when vertical synchronous signal V-SYNC is cut off. When both the horizontal and vertical synchronous signals H-SYNC and V-SYNC are cut off, microcomputer 220 applies a DPMS power off mode to PWM IC 257, to cut off the secondary power of switching transformer 254, reducing the power consumed by display monitor 200. The consumption power of foregoing display monitor employing the DPMS mode is reduced to 5 W or less in the DPMS power off mode which is a power saving function. Accordingly, a specific amount of power is consumed even when the display monitor is not used.

Figure 2:
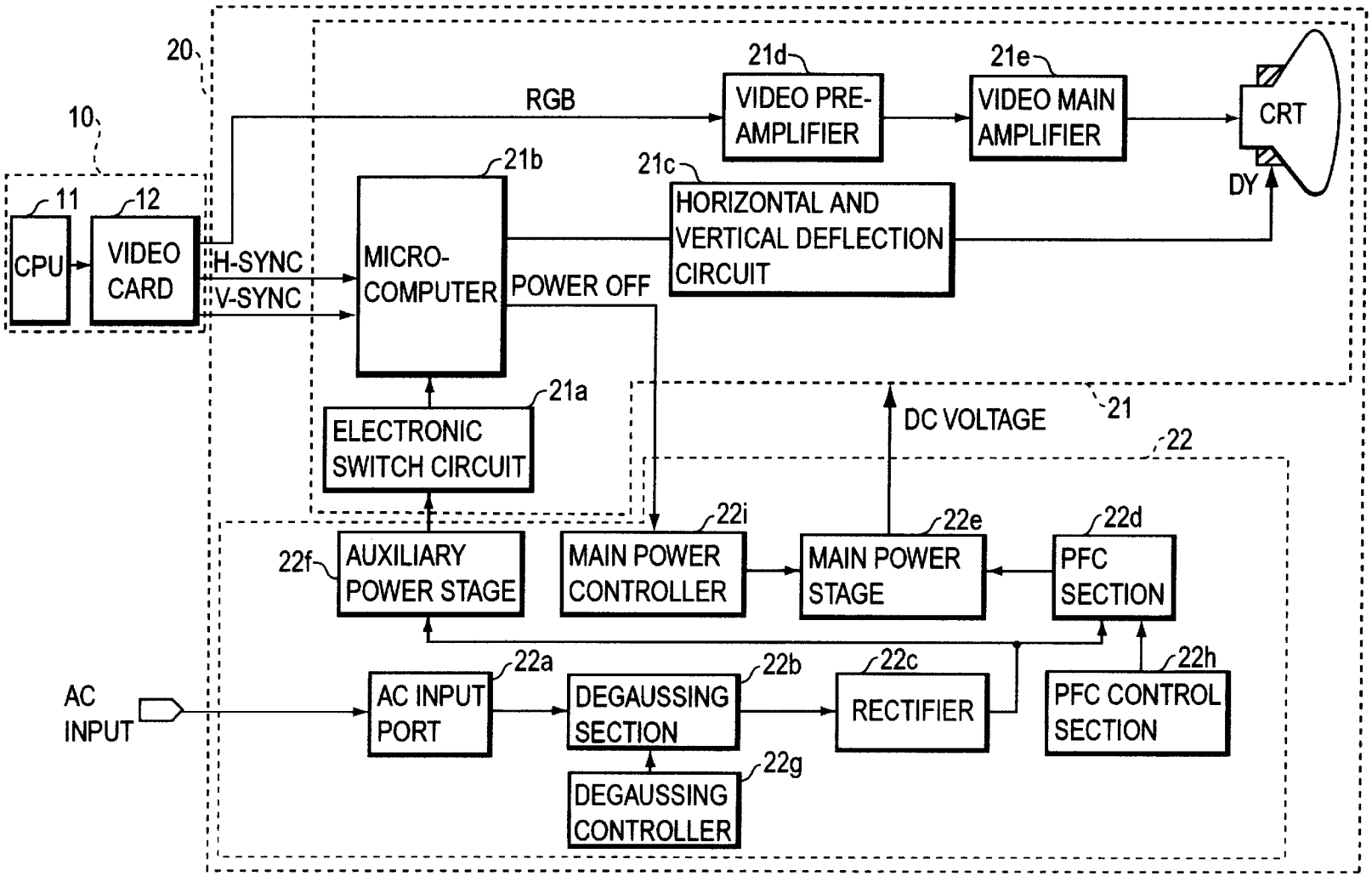
FIG. 2 is a block diagram showing the inner circuit of a display monitor according to the principles of the present invention.

FIG. 2 is a block diagram showing the configuration of the inner circuit of a display monitor according to the present invention. Referring to FIG. 2, a computer 10 consists of a CPU 11 for receiving and processing a keyboard signal, to generate data, and a video card 12 for receiving the data from CPU 11, processing it into a RGB video signal, and generating horizontal and vertical synchronous signals H-SYNC and V-SYNC for synchronizing the RGB video signal. A display monitor 20, which receives the RGB video signal from video card 12 and displays it, consists of a video signal processor 21 for receiving the RGB video signal, horizontal and vertical synchronous signals H-SYNC and V-SYNC from video card 12, judging the resolution and frequency of the RGB video signal, processing the video signal and displaying it, and a power circuit 22 for receiving AC externally supplied and rectifying it to generate a DC voltage required for video signal processor 21.

Video signal processor 21 includes an electronic switch circuit 21 a for selecting or canceling the power saving mode as the power mode of display monitor 20, a microcomputer 21*b* for receiving horizontal and vertical synchronous signals H-SYNC and V-SYNC from video card 12 of computer 10, judging information such as resolution and frequency of the RGB video signal to output an oscillation signal and outputting a power off signal according to a switch signal output from electronic switch circuit 21*a,* a horizontal and vertical deflections circuit 21*c* for receiving the oscillation signal from microcomputer 21*b,* and generating horizontal and vertical sawtooth wave currents to deflection yoke DY to determine horizontal and vertical scanning cycles when the RGB video signal is displayed on the CRT, a video pre-amplifier 21*d* for receiving the RGB video signal from video card 12 of computer 10, and amplifying it to a predetermined level, and a video main amplifier 21*e* for receiving the RGB video signal amplified to the predetermined level by video pre-amplifier 21*d,* and amplifying it sufficiently to provide it to the CRT.

Power circuit 22 includes an AC input port 22*a* for receiving the AC voltage, a degaussing section 22*b* for receiving the AC voltage applied to AC input port 21*a* and removing color spread on the CRT picture, generated by terrestrial magnetism, a rectifier 22*c* for receiving the AC voltage and rectifying it to generate a DC voltage, a power factor correction (PFC) section 22*d* for correcting the power factor of the DC voltage output from rectifier 22*c,* a main power stage 22*e* for receiving the DC voltage whose power factor is corrected by PFC section 22*d* and outputting a DC voltage required for video signal processor 21, an auxiliary power stage 22*f* for receiving the DC voltage from rectifier 22*c,* generating a wake-up voltage and supplying the wake-up voltage to electronic switch circuit 21*a,* a degaussing controller 22*g* for controlling the gain of operation time for degaussing section 22*b* to remove the color spread, PFC control section 22*h* for controlling the gain of the power factor corrected by PFC section 22*d,* and a main power controller 22*i* for stabilizing the output of the DC voltage from main power stage 22*e* and cutting off the DC voltage output from main power stage 22*e* when the power off signal is applied from microcomputer 21*b.*

The operation of the display monitor having the above configuration is explained below. Data generated by CPU 11 of computer 10 is processed by video card 12, to be output as the RGB video signal which is displayed on display monitor 20. This RGB video signal is amplified sufficiently by video pre-amplifier 21*d* and video main amplifier 21*e,* to be sent to the CRT. Then, the CRT scans the RGB video signal according to the cycle of sawtooth wave current generated by deflection yoke DY, displaying an image corresponding to the video signal. The cycle of sawtooth wave current is synchronized with the horizontal and vertical synchronous signals H-SYNC and V-SYNC output from video card 12. Microcomputer 21*b* receives the horizontal and vertical synchronous signals H-SYNC and V-SYNC from video card 12, to judge information about the RGB video signal, that is, resolution and frequency information. Microcomputer 21*b* generates an oscillation signal according to horizontal and vertical synchronous signals H-SYNC and V-SYNC depending on the information obtained about the video signal.

Horizontal and vertical deflection circuit 21*c* receives the oscillation signal from microcomputer 21*b,* drives it, and switches according to the driven current, to generate vertical and horizontal sawtooth wave current. The CRT determines horizontal and vertical scanning cycles of the RGB video signal, applied thereto from video main amplifier 21*e,* according to the cycle of the vertical and horizontal sawtooth wave current, displaying the image. Here, the drive DC voltage for displaying the RGB video signal, output from video card 12 of computer 10, on the CRT is supplied from power circuit 22. Power circuit 22 which supplies the drive DC voltage to video signal processor 21 receives the AC voltage from AC input port 22*a.*

The AC voltage applied through AC input port 22*a* is sent to degaussing section 22*b* and rectifier 22*c.* Degaussing section 22*b* which has received the AC voltage disperses DC components of terrestrial magnetism formed on the shadow mask (not shown) inside the CRT according to a gain controlled by degaussing control section 22*g* for a predetermined period of time, preventing smear of image. Rectifier 22*c,* which has received the AC voltage, rectifies it to generate a DC voltage. The DC voltage is provided to auxiliary power stage 22*f* and to PFC section 22*d* to correct the power factor in response to a gain control signal from PFC control section 22*h.* The power factor corrected DC voltage is then supplied to main power stage 22*e.* Main power stage 22*e,* which has received the DC voltage from PFC section 22*d,* induces the DC voltage to its secondary side, outputting it. This induced DC voltage supplies high voltage to microcomputer 21*b,* horizontal and vertical deflection circuit 21*c* and the CRT of video signal processor 21.

While the RGB video signal output from video card 12 of computer 10 is displayed on the CRT with the DC supplied from power circuit 22, display monitor 20 may do not operate for a predetermined period of time when a user or computer 10 takes a rest. During the suspension of display monitor 20, the user stops display monitor 20 using electronic switch circuit 21*a* so as to reduce consumption power. When a switch signal is generated by electronic switch circuit 21*a* according to the user's selection, microcomputer 21*b* receives this switch signal and generates the power off signal to save the power consumed by display monitor 20 according to the switch signal. When electronic switch circuit 21*a* generates the switch signal, it receives voltage for canceling the power off from auxiliary power stage 22*f.*

The power off signal generated by microcomputer 21*b* is sent to main power controller 22*i* which controls main power stage 22*e* according to the power off signal, cutting off the output of DC voltage. Main power stage 22*e* is controlled by main power controller 22*i,* to cut off the DC voltage output to its secondary side, thereby cutting off the DC voltage supplied to video signal processor 21. Accordingly, display monitor 20 is in power off state. The microcomputer is also in power off state, resulting in reduction in the power consumed by display monitor 20 to less than 1 W.

Figure 3:
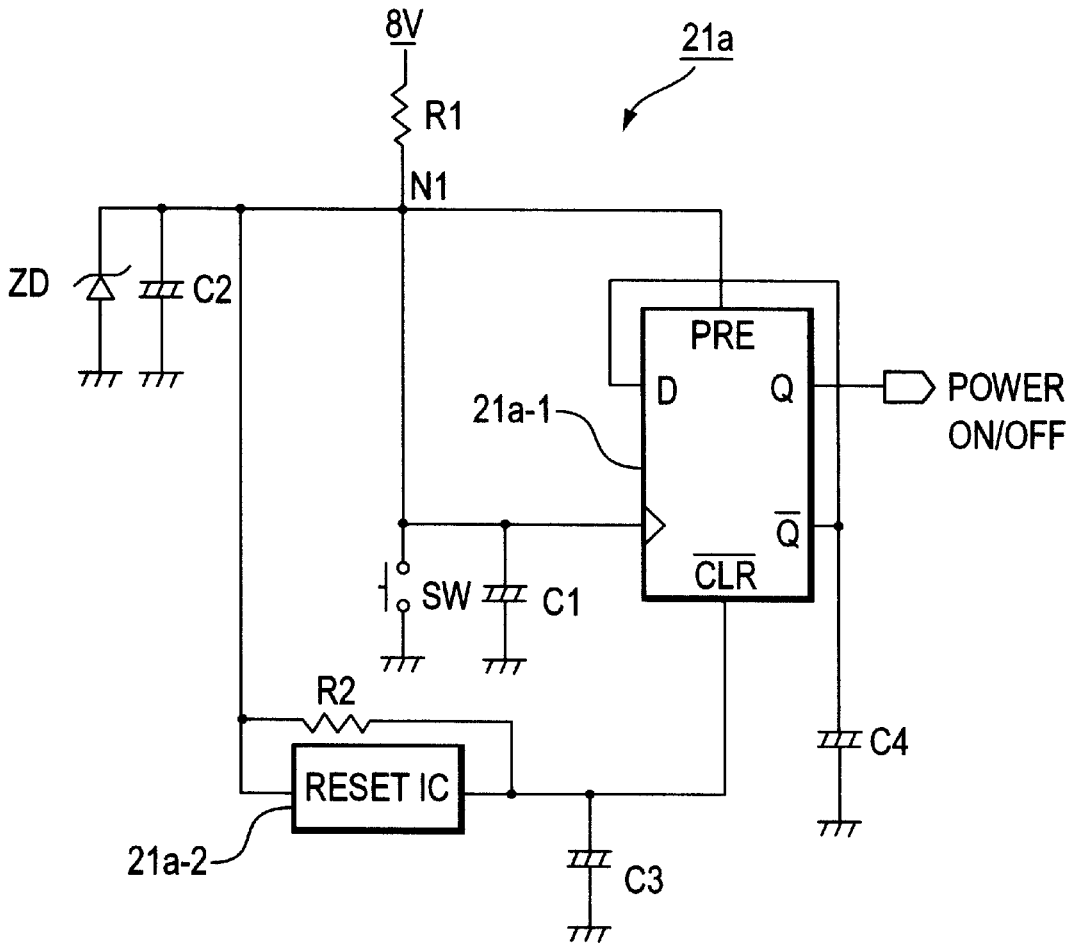
FIG. 3 is circuit diagram of the electronic switch circuit shown in FIG. 2.

Electronic switch circuit 21*a,* selected for saving consumption power in display monitor 20, is explained below in more detail with respect to FIG. 3. Referring to FIG. 3, electronic switch circuit 21*a* includes a switch SW (normally open) selected to cut off power to display monitor 20 (shown in FIG. 2), a D flip-flop 21*a*-1 for generating a power on signal or a power off signal in response to user activation of switch SW, a reset integrated circuit (IC) 21*a*-2 for receiving a wake up voltage (8V) from auxiliary power stage 22*f* to reset D flip-flop 21*a*-1. A resistor R1 is connected in series between the 8V source and a node N1. A zener diode ZD connected to node N1 provides a reference voltage to the clock, preset PRE and clear $\overline{CLR}$ ports of D flip-flop 21*a*-l and to reset IC 21*a*-2. A resistor R2 is coupled in parallel with reset IC 21*a*-2 to provide a path for the reference voltage from zener diode ZD to the clear port $\overline{CLR}$ of D flip-flop 21*a*-1. The D port of D flip-flop 21*a*-1 is connected to the $\overline{Q}$ output port, and the Q output port provides the power on or power off signal to microcomputer 21*b.* A capacitor C1 is connected between the clock port of D flip-flop 21*a*-1 and a ground terminal in order to prevent noise from being applied to the clock port. A capacitor C2 is connected between the preset port of D flip-flop 21*a*-1 and the ground terminal to remove noise, a capacitor C3 is connected between the clear port $\overline{CLR}$ of D flip-flop 21*a*-1 and the ground terminal to remove noise, and a capacitor C4 is connected between the $\overline{Q}$ output port of D flip-flop 21*a*-1 and the ground terminal to remove noise.

The operation of electronic switch circuit 20 having the above configuration is described below in detail. When a user determines that display monitor 20 will not be needed for a predetermined time, the user closes switch SW and the voltage at preset port PRE becomes low, reset IC 21*a*-2 supplies a pulse to the clear port $\overline{CLR}$, the Q output port becomes high and the $\overline{Q}$ output port becomes low. When switch SW is released the voltage at preset port PRE becomes high, the reference voltage is applied via resistor R2 to the clear port $\overline{CLR}$, the reference voltage is applied to the clock port, the low voltage at the data port D is output through the Q output port and the $\overline{Q}$ output port becomes high. When switch SW is closed again the voltage at preset port PRE becomes low, reset IC 21*a*-2 applies a pulse to the clear port $\overline{CLR}$, the Q output port becomes high and the $\overline{Q}$ output port becomes low. Accordingly, microcomputer 21*b* generates the power off signal when switch SW is closed a first time, and then generates a power on signal when switch SW is closed a second time, thereby controlling main power stage 22*e* (shown in FIG. 2) through main power controller 22*i* (shown in FIG. 2) according to the applied signal, to control the output of DC voltage, thereby executing the power saving mode by turning off the display monitor and then turning on the display monitor when the power saving mode is no longer desired.

Accordingly, turning on/off of display monitor 20 is controlled using the switch SW. Furthermore, when the display monitor is turned off, the microcomputer is simultaneously turned off. By doing so, the power consumed by the display monitor can be reduced to less than 1 W. As described above, the present invention turns off the microcomputer when the display monitor is turned off, using the electronic switch circuit, so as to minimize the consumption power in the display monitor, resulting in power saving.

It will be apparent to those skilled in the art that various modifications and variations can be made in the low consumption power circuit using an electronic switch in a display monitor of the present invention without departing from the spirit or scope of the invention. Thus, it is intended that the present invention cover the modifications and variations of this invention provided they come within the scope of the appended claims and their equivalents.

What is claimed is:

1. A low consumption power circuit using an electronic switch in a display monitor, comprising:

an electronic switch circuit for selecting or canceling a power saving mode as the power mode of the display monitor;

a microcomputer for generating a power cut off signal in response to a switch signal output from the electronic switch circuit when said power saving mode is selected; and a main power controller for cutting off a direct current voltage output from a main power stage when it receives the power cut off signal generated by the microcomputer, wherein the electronic switch comprises:

a switch selected for cutting off power to the display monitor;

a D flip-flop for generating power off signal depending on the level of a direct current voltage applied according to selecting of the switch; and a reset integrated circuit for resetting the D flip-flop.

2. The circuit as claimed in claim 1, further comprising an auxiliary power stage for receiving a direct current voltage, which is rectified by a rectifier, to supply a wake up voltage to said electronic switch.

3. A low consumption power circuit using an electronic switch in a display monitor, comprising:

an electronic switch circuit for selecting or canceling a power saving mode as the power mode of the display monitor;

a microcomputer for generating a power cut off signal in response to a switch signal output from the electronic switch circuit when said power saving mode is selected; and a main power controller for cutting off a direct current voltage output from a main power stage when it receives the power cut off signal generated by the microcomputer, wherein the electronic switch comprises:

a D flip-flop for generating one of a power off signal and a power on signal, said D flip-flop having a data input port connected to a $\overline{Q}$ output port and a Q output port connected to said microcomputer, said $\overline{Q}$ output port being further connected to a ground terminal via a first noise filtering capacitor;

a voltage source for providing a direct current voltage to a clock port of said D flip-flop via a first resistor;

a switch connected to said first resistor at a node, said switch being further connected between said ground terminal and said clock port for cutting off said direct current voltage provided to said clock port;

a second noise filtering capacitor connected between said ground terminal and said clock port for preventing noise from being applied to said clock port;

a zener diode connected between said ground terminal and said node, said zener diode providing a reference voltage to a preset port of said D flip-flop via said node and providing said reference voltage to a clear input port of said D flip-flop via a second resistor;

a third noise filtering capacitor connected between an anode of said zener diode and said ground terminal;

a reset circuit for resetting said D flip-flop, said reset circuit being connected in parallel with said second resistor; and a fourth noise filtering capacitor connected between said clear input port and said ground terminal.

4. A method for controlling power consumption in a display monitor having a power circuit and a video signal processor, said video signal processor comprising a microcomputer and an electronic switch, said method comprising:

converting an alternating current voltage into a wake up direct current voltage and a direct current supply voltage in said power circuit;

supplying said wake up direct current voltage to said electronic switch;

supplying said direct current supply voltage to said video signal processor;

generating a power off signal by manually activating said electronic switch, when an operator desires to reduce power consumption of said display monitor desires to, said power off signal being supplied to said microcomputer; and stopping said step of supplying said direct current supply voltage to said video signal processor to turn off said display monitor on order to reduce power consumption by said display monitor, when said microcomputer receives said power off signal.

5. The method as set forth in claim 4, further comprising steps of:

generating a power on signal by again manually activating said electronic switch, when said operator desires to turn said display monitor on again, said power on signal being supplied to said microcomputer; and performing said step of supplying said direct current supply voltage to said video signal processor when said microcomputer receives said power on signal.

6. A low consumption power circuit for a display monitor, comprising: a video signal processor comprising:

an electronic switch circuit for selecting a power saving mode as the power mode of the display monitor; and a microcomputer for generating a power cut-off signal according to a switch signal output from said electronic switch circuit; and a power circuit comprising:

means for converting a received alternating current voltage into a direct current supply voltage;

an auxiliary power stage for generating a wake up voltage to be supplied to said electronic switch; and a main power controller for supplying said direct current supply voltage to said video signal processor, said main power controller for cutting off said direct current supply when said microcomputer generates said power cut-off signal wherein the electronic switch comprises:

a switch selected for cutting off power to the display monitor;

a D flip-flop for generating one of a power off signal or a power on signal depending on the level of a direct current voltage applied according to user activation of said switch; and a reset integrated circuit responsive to said wake up voltage or to user activation of said switch for resetting the D flip-flop.

7. A low consumption power circuit for a display monitor, comprising:

a video signal processor comprising:

an electronic switch circuit for selecting a power saving mode as the power mode of the display monitor; and a microcomputer for generating a power cut-off signal according to a switch signal output from said electronic switch circuit; and a power circuit comprising:

means for converting a received alternating current voltage into a direct current supply voltage;

an auxiliary power stage for generating a wake up voltage to be supplied to said electronic switch; and a main power controller for supplying said direct current supply voltage to said video signal processor, said main power controller for cutting off said direct current supply when said microcomputer generates said power cut-off signal, wherein the electronic switch comprises:

a D flip-flop for generating one of a power off signal and a power on signal, said D flip-flop having a data input port connected to a $\overline{Q}$ output port and a Q output port connected to said microcomputer, said $\overline{Q}$ output port being further connected to a ground terminal via a first noise filtering capacitor;

a voltage source for providing a direct current voltage to a clock port of said D flip-flop via a first resistor;

a switch connected to said first resistor at a node, said switch being further connected between said ground terminal and said clock port for cutting off said direct current voltage provided to said clock port;

a second noise filtering capacitor connected between said ground terminal and said clock port for preventing noise from being applied to said clock port;

a zener diode connected between said ground terminal and said node, said zener diode providing a reference voltage to a preset port of said D flip-flop via said node and providing said reference voltage to a clear input port of said D flip-flop via a second resistor;

a third noise filtering capacitor connected between an anode of said zener diode and said ground terminal;

a reset circuit for resetting said D flip-flop, said reset circuit being connected in parallel with said second resistor; and a fourth noise filtering capacitor connected between said clear input port and said ground terminal.

8. The circuit as claimed in claim 7, wherein said reset circuit resets said D flip-flop in response to receipt of said wake up voltage or to user activation of said switch.

* * * * *